United States Patent [19]

Davidson et al.

[11] 4,316,562

[45] Feb. 23, 1982

[54] BUTTON ATTACHING TOOL

[75] Inventors: Donald R. Davidson, Berkeley Heights; Wesley R. Peterson, Boundbrook, both of N.J.

[73] Assignee: The Singer Company, Stamford, Conn.

[21] Appl. No.: 145,939

[22] Filed: May 2, 1980

[51] Int. Cl.[3] ..... D05B 85/00; D05B 3/14

[52] U.S. Cl. ..... 223/102; 112/110; 112/169; 227/68

[58] Field of Search ..... 112/110, 80, 169, 79 R; 223/102; 227/68

[56] References Cited

U.S. PATENT DOCUMENTS 549,840 11/1895 Bagby ..... 112/79 R
1,017,247 2/1912 Carson ..... 112/224
2,605,943 8/1952 Hoefle ..... 223/102
3,404,707 10/1968 Feld ..... 223/102 X
3,875,648 4/1975 Bone ..... 227/68
4,111,347 9/1978 Bone ..... 227/68

FOREIGN PATENT DOCUMENTS 681147 4/1938 Fed. Rep. of Germany .

*Primary Examiner*—H. Hampton Hunter
*Attorney, Agent, or Firm*—William V. Ebs; Robert E. Smith; Edward L. Bell

[57] ABSTRACT

A button attaching tool is provided with a base, a pair of needles which have collapsible and expandable thread receiving eyes and which project from the base for use in penetrating a layer of material and the holes of a button to be attached to the material, and a member for stripping the material and button from the needles.

11 Claims, 6 Drawing Figures

Fig. 3.
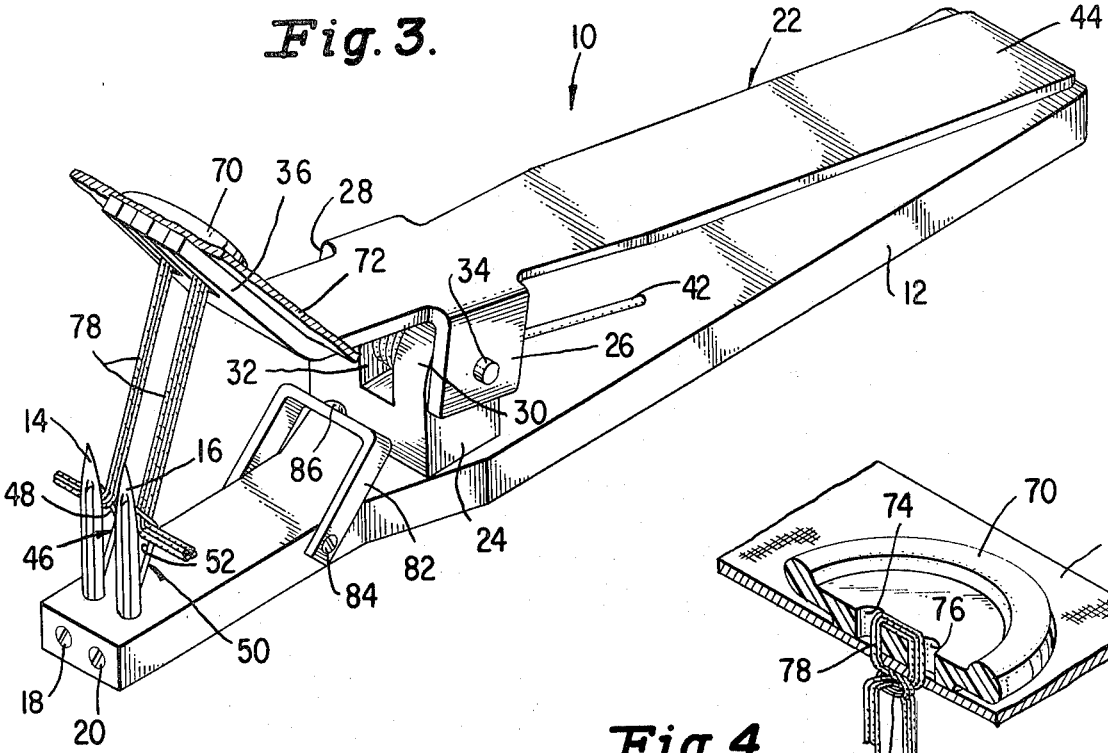
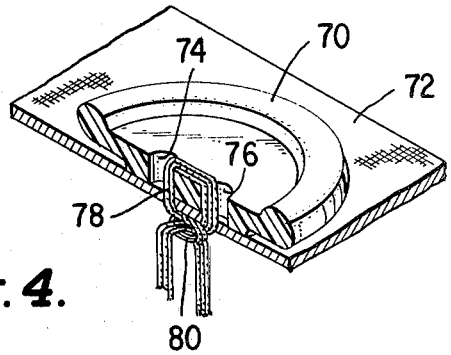
Fig. 4.
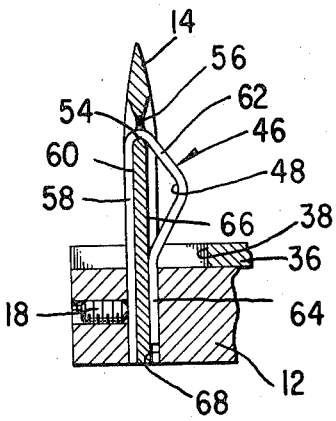
Fig. 5.
Fig. 6.
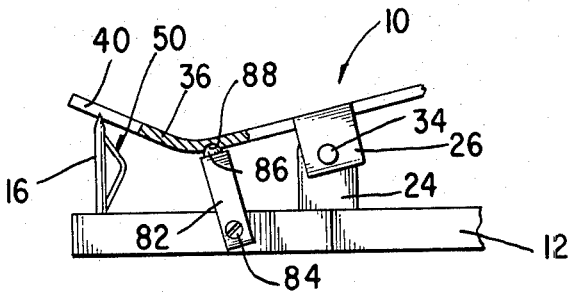

BUTTON ATTACHING TOOL

BACKGROUND OF THE INVENTION

1. Field of the Invention

The invention is directed to a tool which facilitates the attachment of a button to a fabric.

2. Description of the Prior Art

Button attaching aids, of which the device shown and described in U.S. Pat. No. 2,605,943 of A. O. Hoefle issued Aug. 5, 1952, and the apparatus disclosed in U.S. Pat. No. 4,111,347 of Arnold R. Bone issued Sept. 5, 1978 are examples, are well known. However the presently known button attaching aids are deficient in various respects. In general they are difficult to thread, perform unreliably, and are inefficient, or they are unduly complex and costly to produce.

It is a prime object of this invention to provide an improved button attaching tool which is simply constructed, easily threaded, can be quickly and easily operated, and performs reliably.

SUMMARY OF THE INVENTION

In accordance with the invention, a button attaching tool is provided with a base and a pair of needles projecting from the base for use in penetrating a layer of material and the holes of a button to be attached to the material. Each needle has a length of resilient wire thereon forming an eye which can collapse to pass through the material and buttonholes during penetration thereof by the needle, and expand to receive and hold a thread bundle after having passed through the material and button. A member mounted for movement on the base and engageable with the underside of the material is operable to strip the material and button from the needles.

DESCRIPTION OF THE DRAWINGS

FIG. 3 is a perspective view showing the fabric and button being stripped from the tool;

FIG. 4 is an enlarged perspective view showing the button and fabric after having being removed from the tool; and FIG. 5 is an enlarged sectional view taken through a needle of the button attaching tool;

FIG. 6 is a perspective view showing the tool with a stripping member thereon latched in a safe position.

DESCRIPTION OF THE PREFERRED EMBODIMENT OF THE INVENTION

Figure 1:
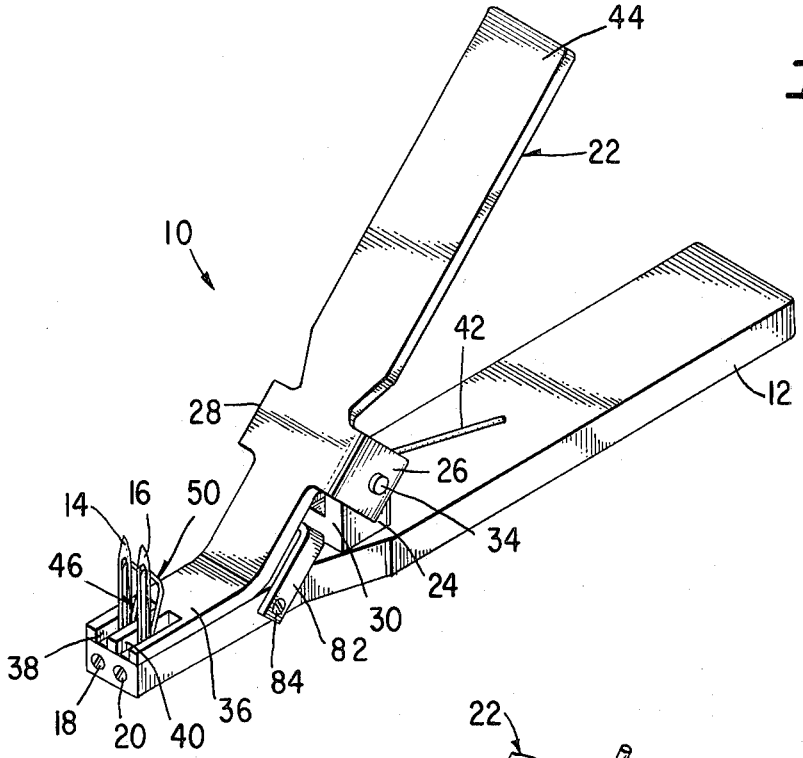
FIG. 1 is a perspective view of the button attaching tool of the invention.

Referring to the drawings, reference character 10 designates a button attaching tool according to the invention including a base 12 wherein a pair of needles 14 and 16 are affixed with set screws 18 and 20 respectively. The base supports a member 22 on a fixed support 24. As shown, member 22 includes depending side flanges 26 and 28 which bracket bosses 30 and 32 on the support 24. A pin 34 extends through the side flanges 26 and 28 of member 22 and through bosses 30 and 32 on support 24 to render the member 22 pivotally movable.

Figure 2:
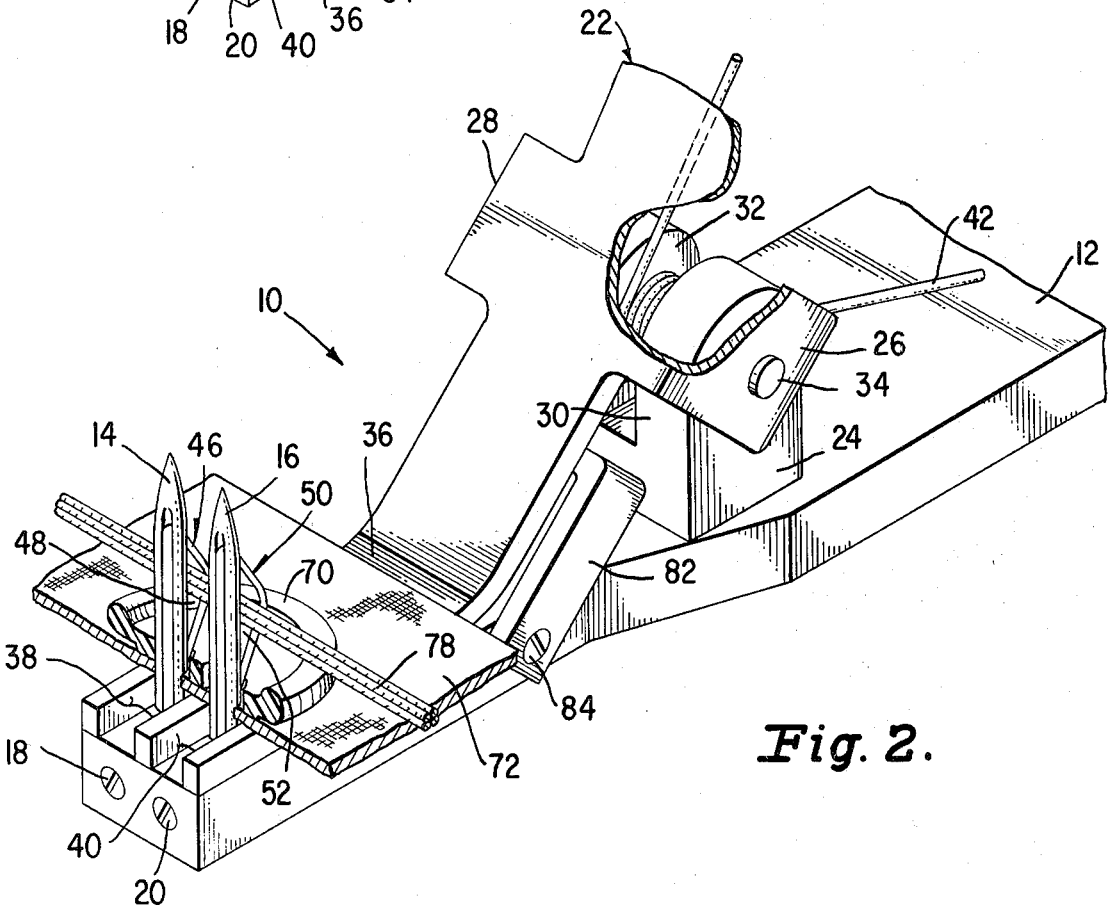
FIG. 2 is an enlarged fragmentary perspective view showing a layer of fabric and button in place on the button attaching tool.

Member 22 includes an angled end portion 36 which extends over the needle carrying portion of the base 12 and includes needle accommodating slots 38 and 40. A biasing spring 42 which is wrapped around pin 34 and engages the base and member 22 at opposite ends, causes the member 22, except when locked in an inoperative position as hereinafter described, to assume a position as shown in FIGS. 1 and 2 with angled end portion 36 against the base 12. However, end portion 36 of member 22 may be lifted (see FIG. 3) from the base with the application of hand or finger pressure to the end portion 44 of member 22 opposite from the angled end portion 36. The needles 14 and 16 project through slots 38 and 40 respectively of member 22 when the member is disposed with angled portion 36 against the base.

Each of the needles 14 and 16 includes a length of resilient wire which forms a contractible and expandable thread receiving eye with the needle column. As shown a wire 46 on needle 14 forms thread receiving eye 48 and a wire 50 on needle 16 forms a thread receiving eye 52. Needle 14 including wire 46 is constructed in the same manner as needle 16 including the wire 50. Such construction is best shown in FIG. 5 wherein wire 46 on needle 14 is depicted as extending through a conventional needle eye 54 and affixed to the needle at such eye with a tack weld 56. A portion 58 of the wire extends from the eye 54 along a groove 60 on one side of the needle 14 and into the base 12 where it is secured with the needle by screw 18. Another portion 62 of the wire extends to the other side of the needle eye 54 to form the thread receiving eye 48. Such wire portion 62 extends into a free end portion 64 which registers in and is slidable in a needle groove 66. As shown the free end portion extends along needle groove 66 and into hole 68 in the base 12.

The tool 10 is utilized to attach a button 70 to a layer of cloth 72 by forcing the cloth down over the needles 14 and 16 while the movable member 22 is in its normal position with the angled portion 36 against the base 12. The cloth is forced over the wire formed eyes 48 and 52 and into a position wherein it is flat against angled portion 36. As the needles penetrate the cloth, pressure of the cloth on the wire portions forming the eyes 48 and 52 causes the free end portions of the wire to move along the needle in the grooves wherein they are situated, and the eyes 48 and 52 contract to pass freely through the cloth. Once the cloth 72 has moved beyond the eyes 48 and 52, the eyes expand to trap and prevent the cloth from accidentally being lifted off the needles projecting through it.

While the cloth 72 is against angled portion 36 of member 22, button 70 is disposed with holes 74 and 76 in alignment with needles 14 and 16 respectively, and moved onto the cloth in a manner causing the needles to penetrate the button through the holes therein and project beyond as shown in FIG. 2. The wire formed eyes 48 and 52 of the needles contract to permit easy passage through the buttonholes and expand to fully open positions as the button assumes a position against the cloth 72. In the fully open position of the wire formed eyes accidental separation of the buttons from the cloth is effectively prevented by the wire. While the button 70 is on the cloth 72 a bundle of threads 78 is threaded through the eyes 48 and 52 where it is temporarily held. Hand or finger pressure is then applied to end portion 44 of member 22 to pivot the member about pin 34 against the bias of spring 42, and so move the angled end portion 36 of the member off the base. The angled end portion 36, as it moves away from the base, strips the button 70 and cloth from the needles and causes the thread bundle 78 extending through the wire formed eyes 48 and 52 to be pulled through buttonholes 74 and 76, and through the cloth 72 (see FIG. 3). As the button and cloth are extricated from the needle the wire formed eyes temporarily contract and pass through the buttonholes and cloth without difficulty.

After the button 70 and cloth 72 have been stripped from the needles and while the angled end portion 36 of member 22 is above the needles, the button and cloth are removed from the tool by the operator. Following such removal, end portions of the thread bundle may be tied into a knot 80 to permanently secure the button to the cloth (see FIG. 4), after which loose hanging thread ends would be cut away.

The tool 10 includes a latching gate 82 which is mounted for pivotal movement on the axis of a screw 84. The gate rests in a position against the base 12 as in FIGS. 1, 2 and 3 while the tool is operative, but can be pivoted into a position (FIG. 6) wherein a protuberance 86 on the gate registers in a recess 88 in member 22 and is effective to hold the member 22 with angled portion 36 above the points of the needles 14 and 16. With the angled portion 36 held above the needles in this manner, accidental injury by contact with the needle to someone picking up the tool is prevented.

The tool of the invention can be used, if desired, with shank buttons as well as the more conventional type button shown in the drawings. If a shank button has only a single button hole, it can be conveniently attached to a material as by first having the needles pierce the material and then placing the shank with the buttonhole between the wire eyes of the needle, after which the wire eyes and buttonhole would be hand threaded. The material and button would then be stripped from the tool and the thread tied. It is to be understood that the present disclosure relates to a preferred embodiment of the invention which is for purposes of illustration only and is not to be construed as a limitation of the invention. Numerous alterations and modifications of the structure herein disclosed will suggest themselves to those skilled in the art, and all such modifications and alterations which do not depart from the spirit and scope of the invention are intended to be included within the scope of the appended claims.

We claim:

1. A button attaching tool including a base; a pair of needles projecting from the base for use in penetrating a layer of material and extending through the holes of a button to be attached to the material, each such needle having a length of resilient wire thereon forming an eye which can collapse to pass through the material and buttonholes, and expand to receive and hold a thread bundle over the material and button; and a member mounted for movement on the base, engageable with the underside of the material, and operable to strip the material and button from the needles.

2. The combination of claim 1 wherein the movable member is spring biased into engagement with the base.

3. The combination of claim 1 wherein the wire on each needle includes a free end which extends into and is movable in the base.

4. The combination of claim 1 wherein the wire on each needle extends to both sides of the needle, is secured on one side and is free on the other.

5. The combination of claim 4 wherein the free end of the wire on each needle is slidable in a groove in the needle.

6. The combination of claim 5 wherein the free end of the wire on each needle extends into the base.

7. The combination of claim 6 wherein the end of the wire on each needle opposite from the free end is affixed to the base.

8. The combination of claim 1 including spring means for exerting a biasing force on the movable member, said member being pivotally mounted on the base and including an angled end portion which is disposable against the base by the action of said spring means and is engageable with the underside of the material to which the button is to be attached, the member being actuable to cause the angled end portion to strip the material and button from the tool.

9. The combination of claim 8 wherein the angled end portion of the movable member includes slots through which the needles may project while the angled end portion is against the base and while stripping the material and button from the tool.

10. The combination of claim 8 including means for latching said movable members in a position wherein the angled end portion extends over the needles to protect an operator from injury.

11. A button attaching tool including a base; a pair of needles projecting from the base for use in penetrating a layer of material and attaching a button thereto, each such needle having a length of resilient wire thereon forming an eye which can collapse to pass through the material and expand to receive thread which is also passed through a buttonhole disposed between the eyes; and a member mounted for movement on the base engageable with the underside of the material and operable to strip the material and button from the needles.

* * * * *